US009726461B2

(12) United States Patent
Dennis et al.

(10) Patent No.: US 9,726,461 B2
(45) **Date of Patent: *Aug. 8, 2017**

(54) ROV TERRAIN DISRUPTOR

(71) Applicant: QINETIQ LIMITED, Farnborough, Hampshire (GB)

(72) Inventors: Charles William Dennis, Sevenoaks (GB); Ian Huggett, Crowborough (GB); David Keith Wallington, Orpington (GB)

(73) Assignee: QINETIQ LIMITED, Farnborough (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/921,630

(22) Filed: Oct. 23, 2015

(65) Prior Publication Data

US 2016/0047634 A1 Feb. 18, 2016

Related U.S. Application Data

(63) Continuation of application No. 13/697,895, filed as application No. PCT/GB2011/000798 on May 26, 2011, now Pat. No. 9,194,666.

(30) Foreign Application Priority Data

May 28, 2010 (GB) ..... 1008965.4

(51) Int. Cl.
*F41H 11/16* (2011.01)
*F41H 11/28* (2011.01)

(52) U.S. Cl.
CPC ..... *F41H 11/16* (2013.01); *F41H 11/28* (2013.01)

(58) Field of Classification Search
CPC ..... F41H 11/16; F41H 11/28
See application file for complete search history.

(56) References Cited

U.S. PATENT DOCUMENTS 3,498,177 A * 3/1970 Moro ..... F41H 11/16 180/7.3
4,519,193 A 5/1985 Yoshida et al.
(Continued)

FOREIGN PATENT DOCUMENTS

DE 297 01 232 U1 6/1997
DE 196 14 391 A1 10/1997
(Continued)

OTHER PUBLICATIONS

Apr. 12, 2011 Search Report issued in British Patent Application No. GB1008965.4.
(Continued)

*Primary Examiner* — Reginald Tillman, Jr.
(74) *Attorney, Agent, or Firm* — Oliff PLC

(57) ABSTRACT

A terrain disruption device includes an air or gas flow generation device mounted on a remote operated vehicle having an extendible arm, wherein the air or gas flow generation device includes an elongate (optionally detachable) ducting arrangement to direct the air or gas flow and an optional nozzle. The air or gas flow generation device and/or the elongate ducting arrangement may be mounted on the extendible arm. Preferably, the air or gas flow generation device is powered by a fan, more preferably an electric ducted fan.

21 Claims, 3 Drawing Sheets

(56) References Cited

U.S. PATENT DOCUMENTS

| | | | | |
|---|---|---|---|---|
| 5,966,847 | A * | 10/1999 | Nathenson | B08B 5/02 137/874 |
| 5,988,037 | A | 11/1999 | Haughom et al. | |
| 6,296,459 | B1 | 10/2001 | Saputo et al. | |
| 7,055,615 | B2 | 6/2006 | Dillman | |
| 7,987,760 | B1 * | 8/2011 | Lundquist | F41H 11/12 86/50 |
| 8,381,826 | B2 | 2/2013 | Al-Azemi | |
| 2006/0224280 | A1 | 10/2006 | Flanigan et al. | |
| 2009/0166444 | A1 | 7/2009 | Peterson | |
| 2010/0058024 | A1 | 3/2010 | Kawamura et al. | |
| 2010/0068024 | A1 | 3/2010 | Agens | |
| 2010/0155156 | A1 * | 6/2010 | Finkelstein | B25J 5/007 180/54.1 |
| 2012/0096823 | A1 | 4/2012 | Moore | |
| 2012/0125182 | A1 | 5/2012 | Lundquist et al. | |
| 2012/0210854 | A1 | 8/2012 | Bitar et al. | |
| 2013/0185966 | A1 | 7/2013 | Harrington | |

FOREIGN PATENT DOCUMENTS

| | | | |
|---|---|---|---|
| JP | H11-270997 | A | 10/1999 |
| WO | 00/35332 | A1 | 6/2000 |

OTHER PUBLICATIONS

Aug. 24, 2011 International Search Report issued in Patent Application No. PCT/GB2011/000798.

Aug. 24, 2011 Written Opinion issued in Patent Application No. PCT/GB2011/000798.

Sep. 30, 2010 Search Report issued in British Patent Application No. GB1008965.4.

Feb. 12, 2015 Office Action issued in U.S. Appl. No. 13/697,895.

Sep. 17, 2014 Office Action issued in U.S. Appl. No. 13/697,895.

May 30, 2014 Office Action issued in U.S. Appl. No. 13/697,895.

Apr. 2, 2014 Office Action issued in U.S. Appl. No. 13/697,895.

* cited by examiner

ROV TERRAIN DISRUPTOR

This application is a continuation application of U.S. patent application Ser. No. 13/697,895, filed on Nov. 14, 2012, which is in turn a U.S. National Stage application of International Application No. PCT/GB2011/000798, filed May 26, 2011, which claims the benefit of British Patent Application No. GB 1008965.4 filed May 28, 2010, the entire contents of which are incorporated herein by reference.

This invention relates to the excavation and deactivation of ordnance concealed by terrain. In particular, the invention lies in the field of disrupting loose fill material around unexploded ordnance using a means of generating an air or gas flow mounted on a remote operated vehicle, thereby ensuring operator safety. The invention further relates to components and/or tools that may be powered by the generated gas stream.

By the term unexploded ordnance as used herein is meant any munition (such as, for example, a bomb, rocket, mine or similar device) which has been primed or activated to function, but has yet to function. By the term terrain is meant ground coverings, examples being soil, sand or shale.

According to a first aspect of the invention, there is provided a terrain disruption device comprising an air or gas flow generation device mounted on a remote operated vehicle (ROV) having an extendable arm, wherein the air or gas flow generation device comprises an elongate ducting arrangement to direct the air or gas flow.

The air or gas flow generation device and/or the elongate ducting arrangement may be mounted on the extendable arm. The elongate ducting arrangement may be detachable.

The air or gas flow generation device may be a powered fan, such as, for example, a centrifugal fan, a ducted fan, an open propeller etc. Preferably, the powered fan is a ducted fan. Ducted fans typically comprise a propeller mounted within a cylindrical shroud or duct. The duct reduces losses in thrust and—advantageously—varying the cross-section of the duct allows the designer to control the velocity and pressure of the airflow. Preferably, the ducted fan is mounted on the extendable arm of the ROV.

The fan may be powered by any suitable means, such as—for example—an electrical power source or an engine (e.g. an internal combustion engine powered by a fuel such as petrol, diesel or methane). In a preferred option, the means of powering the fan is an electrical power source, because the use of volatile and/or combustible fuels can increase the risk of an already hazardous operation. A yet further advantage of electrically powered fans is that the power is instantly available, thereby providing simple control of operational speed without the use of gears. In a preferred embodiment, the fan is an electric ducted fan (EDF). The electrical supply may be the power supply of the ROV, ROVs typically being electrically powered so as to avoid the use of volatile fuels. Alternatively, the electric fan may be powered from a separate electrical power source. Examples of electrical power sources are a battery, a fuel cell and/or a photovoltaic cell.

Alternatively, the air or gas flow generation device may be a high pressure gas flow device. The high pressure gas flow device is preferably mounted on the ROV, with an elongate ducting arrangement—preferably a detachable elongate ducting arrangement—mounted on the extendable arm of said ROV. The high pressure gas flow device may be a compressor capable of generating pressurised air or gas, or—alternatively—may be a cylinder of pressurised gas, whose valve may be opened remotely to cause a positive pressure to disrupt the terrain, via the elongate ducting. The high pressure gas flow device may also be a plenum chamber fed by a compressor.

The elongate ducting—preferably detachable elongate ducting—serves to channel the flow of air or gas to or from the immediate vicinity of the covered ordnance, such that the output of the air or gas generation device is not compromised by dust from the disrupted terrain. The elongate ducting may be comprised of one or more modules, so that the overall length of said elongate ducting may be selected by joining together a plurality of modules to create the desired length. In an alternative arrangement, the elongate ducting may be prepared from telescopic modules, such that the adjacent modules slide within each other. This creates a more compact design, thereby reducing the need for separate transportation of additional portions of elongate ducting. Advantageously, the telescopic modules may be locked in position to retain said modules in position.

The elongate ducting may—at the end distal to the air or gas generation device—comprise a nozzle. The nozzle may be fixed, or may be rotatable to more precisely control the direction of the air or gas flow. Conveniently, the end of the nozzle is modified to alter the velocity of the airflow, for example by the use of castellations, veins, spikes, co-axial tubes (Coanda effect) and/or flappers.

The components of the disruption device, such as, for example, the air or gas generation device, any shroud or duct associated with the air or gas generation device (particularly in the case of a ducted fan), the elongate ducting and/or the optional nozzle, may be formed from materials selected from the group consisting of metals, metal alloys, composites, natural polymers, synthetic polymers and fibre reinforced polymers, and any combination thereof. Preferably, the materials are lightweight materials such as, for example, aluminium, carbon fibre reinforced resins or glass fibre reinforced resins, and more preferably the materials are lightweight composites.

It may be desirable to provide certain components that are frangible, so that—in the event of a minor explosive event from the ordnance—the components do not cause further damage to the ROV. Preferably, components such as power supply leads to the preferred electric fan are detachably mounted on the ROV, so that their deployment may be via quick fitting links. This allows rapid deployment and compactness for ease of transport.

The ROV may contain a number of tools and/or components which allow the ordnance to be disposed of. Examples are gripping devices, retrieval devices and/or cutting tools such as cutting discs. The tools may be directly powered by their own separate electric motors; however this may add to the overall weight of the ROV. Accordingly, the tools are preferably powered by the power supply of the ROV, and even more preferably powered by the air or gas flow (as discussed below).

The air or gas flow present in the elongate ducting may be used to perform other work, such as, for example, powering other components or tools. An example is a rotary disc cutting tool, which may be detachably mounted to the ROV, wherein the disc is operably linked to an impeller which is powered by an air supply from an electric fan.

Typically, deactivation of ordnance is carried out remotely. In order that the operator can view events, the ROV is usually fitted with a camera, so as to relay video to the operator in real time. In a highly preferred embodiment, an air bleed is provided from the elongate ducting to produce an air flow across the camera lens. The air flow helps to keep the lens substantially free from debris during the disruption (i.e. excavation) procedure.

The ROV may, upon disruption (excavation) of the terrain, be required to remove small ordnance from the location. Thus, the ROV may employ a retrieval means, one example being an impaling device (such as, for example, a spike or harpoon), to retrieve the ordnance. Another example, suitable for metallic ordnance, is an electromagnet.

For small ordnance, the nozzle may take the form of a hollow spike, with an optional barb, flange or lip appended thereto, wherein said barb, flange or lip may be retractable or fixed. After the airflow (optionally via the nozzle) has disrupted the terrain, the impaling device may impale the ordnance and then retract the ordnance from the location, either through reversing the ROV, or moving the extendable arm, or a combination of both. The barb, flange or lip may help to prevent the ordnance from slipping off of the impaling device during retraction of the ordnance. The ordnance may then be disposed according to normal disposal procedures.

The air or gas flow generation device may be operated to provide a positive air flow (i.e. blow terrain from around the unexploded ordnance) or the device may operate with a negative airflow (i.e. it may create a vacuum, drawing away the loose terrain from around the ordnance). It may be desirable to provide the air intake of a fan with a series of filters to mitigate against the effect of fine particulates reducing the efficiency of the moving parts of said fan.

According to a second aspect of the invention, there is provided a method of uncovering unexploded ordnance comprising the steps of deploying an ROV fitted with a device according to the first aspect to the vicinity of said ordnance and operating the air or gas flow generation device to remove loose terrain from around said ordnance. Preferably, the method comprises the additional step of impaling said ordnance and retracting said ordnance from the original location. The air or gas flow generation device may be a powered fan, preferably an electric ducted fan.

According to a third aspect of the invention, there is provided a kit of parts comprising an ROV, an air or gas generation device, an elongate ducting arrangement and (optionally) a nozzle. Preferably, the air or gas flow generation device is a powered fan, more preferably an electric ducted fan.

The invention also provides a terrain disruption device comprising a ducted fan mounted on an extendable arm of a remote operated vehicle, wherein the fan comprises a detachable elongate ducting arrangement.

The invention further provides a terrain disruption device comprising an electric fan mounted on an extendable arm of a remote operated vehicle, wherein the electric fan comprises a detachable elongate ducting arrangement.

It may be desirable to fit a counter mass to balance the system and/or a stabilising arm to resist an overturning moment of the chassis when a positive airflow is being used.

Any feature in one aspect of the invention may be applied to any other aspects of the invention, in any appropriate combination. In particular, device aspects may be applied to method aspects, and vice versa.

Embodiments of the invention are described below by way of example only and with reference to the accompanying drawings in which.

Figure 3A:
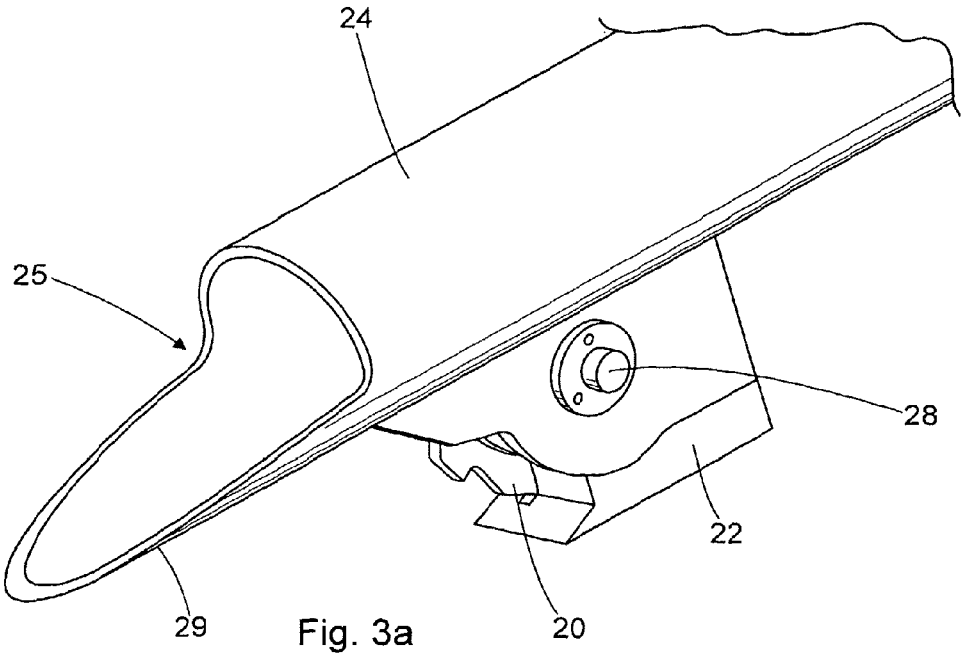
Figure 3B:
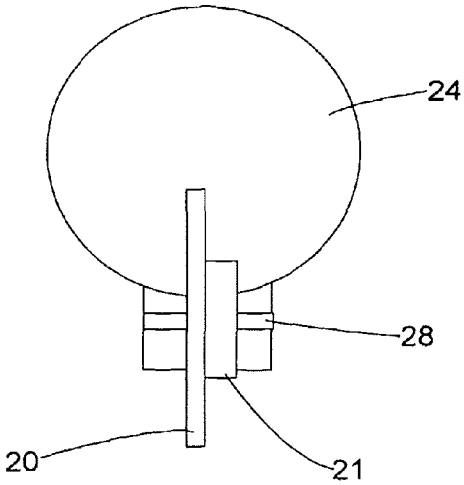

FIG. 3*a* shows a side view of a nozzle configured into a hollow spike arrangement with a cutting disc;

FIG. 3*b* shows a schematic of the cutting disc arrangement shown in FIG. 3*a;*

Figure 4:
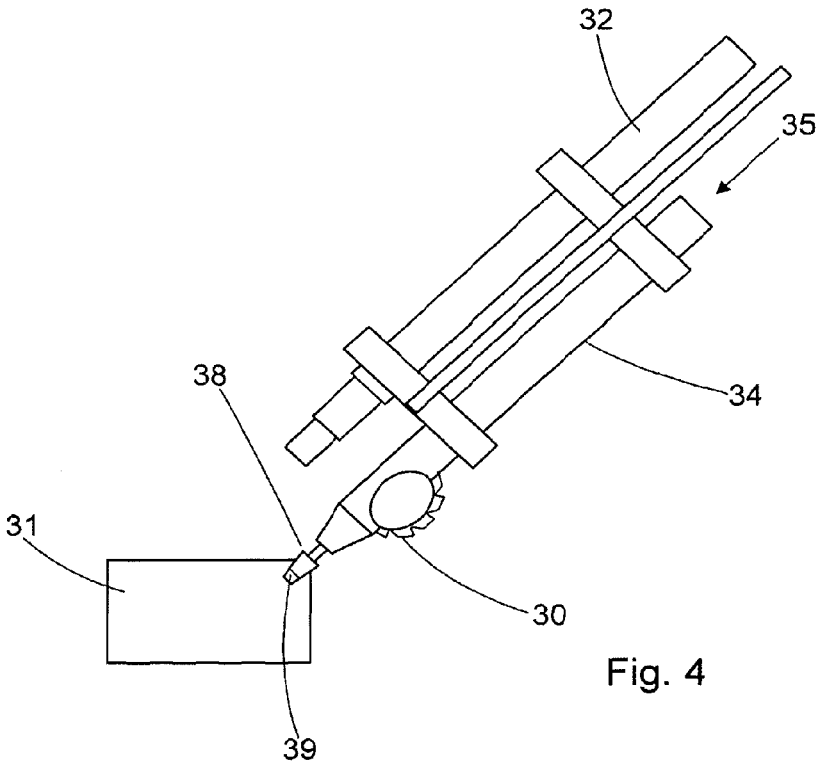
Figure 5:
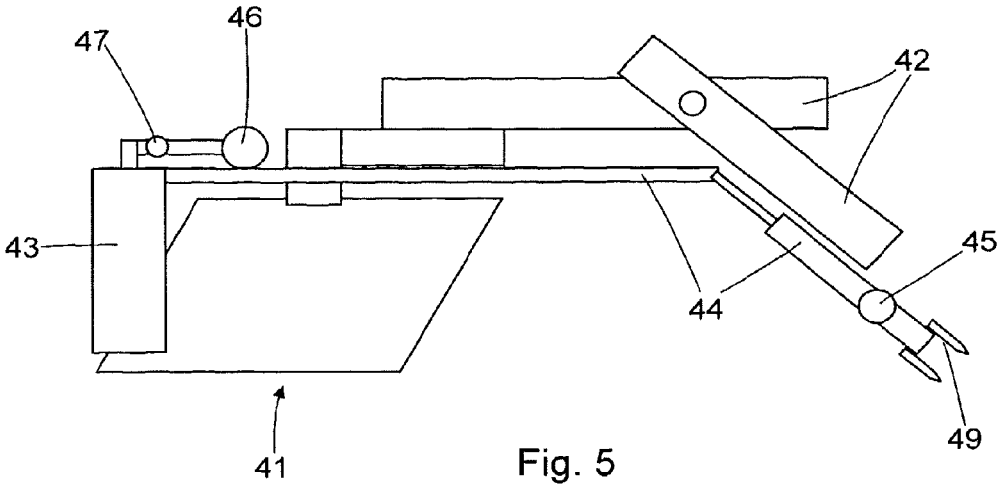

FIG. 4 shows a side view of a nozzle arrangement impaled into an ordnance; and FIG. 5 shows a side view of an ROV with a pressurised gas system.

Figure 1:
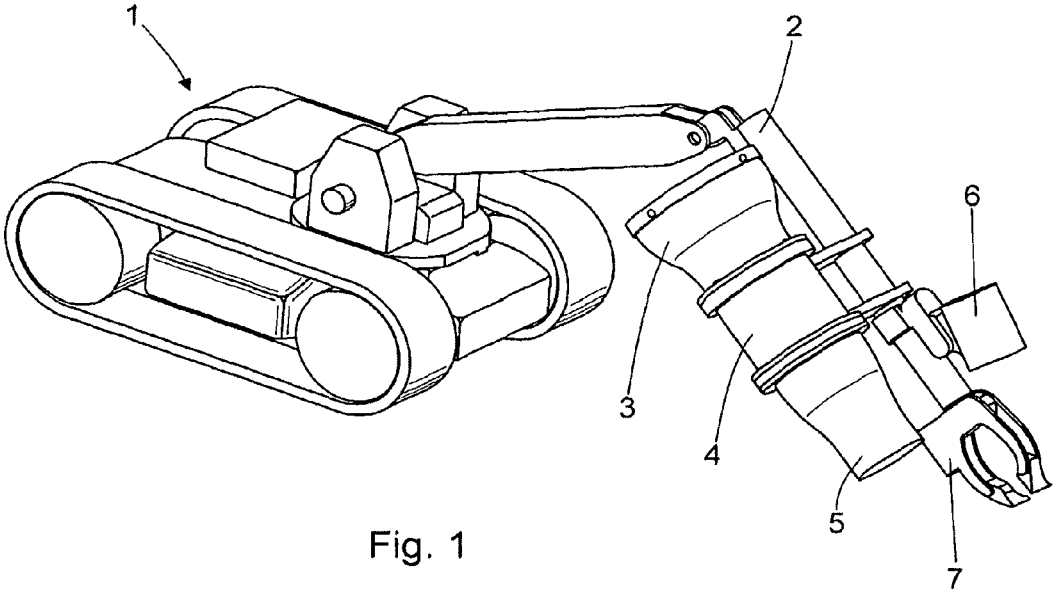
FIG. 1 shows an ROV fitted with a electric ducted fan arrangement.

FIG. 1 shows a schematic representation of a remote operated vehicle 1 with an extendable arm 2 attached thereto. The extendable arm 2 has an electric ducted fan unit 3 mounted thereon, which may be powered by the ROV's own battery supply or a separate battery supply (not shown). In order to allow the ducted fan 3 to be remote from the immediate vicinity of the ordnance, an elongate ducting 4 (which may be of fixed length or adjustable) is attached, and at the end of the elongate ducting 4 is a nozzle 5. The nozzle 5 may be fixed (as shown) such that combined and co-ordinated movement of the ROV 1 and the extendable arm 2 provide control of the direction of the airflow from the end of the nozzle 5. Alternatively, the nozzle 5 may have a directable portion (not shown) to allow the direction of air flow to be readily adjusted during operation without movement of the ROV 1 or extendable arm 2.

The extendable arm 2 may have a number of other auxiliary components or tools appended thereto, such as a pincer 7 and/or a camera 6.

Figure 2:
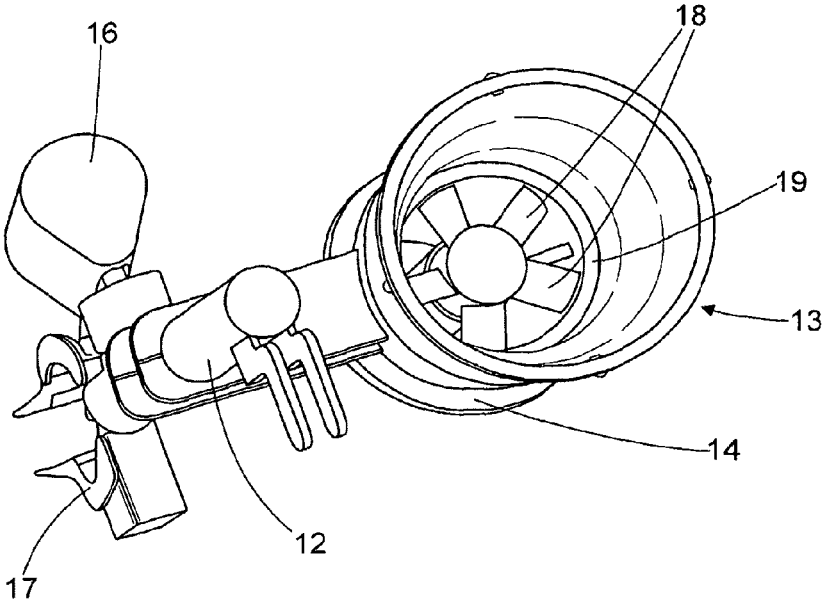
FIG. 2 shows an end on view of the ducted fan mounted to the extending arm.

FIG. 2 shows an end on view of ducted fan 13 mounted on an extendable arm 12, with camera 16 and pincer 17 attached thereto. The ducted fan 13 is comprised of a series of fan blades 18 surrounded by a shroud or duct 19. The duct 19 is attached to the elongate ducting 14 to allow the ducted fan 13 to be located remote from the disrupted terrain and hence, reduce dirt ingress into the ducted fan assembly 13.

FIG. 3*a* shows a side elevation of an elongate ducting 24 which terminates in a nozzle 25 formed into the shape of a hollow spike or hollow sharpened end 29. The hollow spike 29 may further comprise some form of barb or lip (not shown), which may assist the retention of an impaled ordnance (not shown) onto the spike 29. The elongate ducting 24 may also house a cutting disc 20 (optionally mounted on pivot 28, and optionally comprising a "bird's mouth" element 22) which may be powered by the airflow, as is more clearly shown in FIG. 3*b*. In operation, the airflow from the electric ducted fan arrangement shown in FIG. 1 will pass through the elongate ducting 24 out of the hollow spike 29 to disrupt the soil as described in relation to FIG. 1. The hollow spike 29, after disrupting and removing the terrain from around the ordnance (not shown), may then impale said ordnance in an attempt to retract it.

FIG. 3*b* shows an end view of the elongate ducting 24 and a cutting disc 20 which is operably attached to an impeller arrangement 21. The disc 20 and impeller 21 are co-axially mounted on pivot 28 about which they are free to rotate. Upon a positive air flow being produced, the impeller 21 is forced to rotate, thus causing the cutting disc 20 to rotate.

In an alternative arrangement, the impeller 21 and cutting disc may be located remote from the elongate ducting 24, and an air bleed may be taken from the elongate ducting 24 to power the disc cutting arrangement (not shown).

FIG. 4 shows a side view of the extendable arm 32, with an elongate ducting 34 mounted thereon. The elongate ducting 34 has an in-line impeller driven cutting disc 30 mounted therein, the positive air flow 35 being provided by the ducted fan (not shown). The nozzle 39 is in the form of a frustroconical hollow spike, which has been impaled into an unexploded ordnance 31. The nozzle 39 has a trapezoidal shape so that the rearward surface 38 may act as a barb, flange or lip such that the ordnance 31 may not readily slip from the nozzle 39. Thus, the ordnance may be extracted from its current location.

FIG. 5 shows a schematic of a remote operated vehicle 41 having an extendable arm 42. The extendable arm 42 has an elongate ducting 44 attached thereto, and at the end of the elongate ducting 44 is a nozzle 49. The air or gas flow is provided by a plenum chamber 43 which houses a pressurised gas, which may be pre-charged (i.e. single use). Alternatively, pressurised gas may be generated in-situ by a compressor 46 connected to the chamber 43 via control valve 47.

The output from the chamber 43 is fed via the elongate ducting 44. The flow may be varied by control valve 45, which may be a ball valve operated by a stepper motor to allow incremental changes to the flow rate.

It will be understood that the present invention has been described above purely by way of example, and modification of detail can be made within the scope of the invention. Each feature disclosed in the description and (where appropriate) the claims and drawings may be provided independently or in any appropriate combination.

Moreover, the invention has been described with specific reference to the excavation and deactivation of ordnance. It will be understood that this is not intended to be limiting and the method of the invention may be used more generally in applications where an object, particularly a hazardous object, needs to be remotely excavated and (optionally) removed from its original location.

The invention claimed is:

1. A terrain disruption device for uncovering unexploded ordnance located beneath the terrain, the terrain disruption device comprising:

an air or gas flow generation device configured to generate air or gas flow and be mounted on a remote operated vehicle (ROV) having a camera and an extendable arm, the air or gas flow generation device including a powered fan and an elongate ducting arrangement to direct air or gas flow, and a component or tool powered by the air or gas flow generated by the air or gas flow generation device;

wherein the air or gas flow generation device is configured to generate the air flow or the gas flow that disrupts the terrain in the vicinity of unexploded ordnance, so as to uncover the ordnance without causing activation of the ordnance.

2. The device according to claim 1, wherein the elongate ducting arrangement is detachable.

3. The device according to claim 1, wherein at least one of the powered fan and the elongate ducting arrangement is configured to be mounted on the extendable arm.

4. The device according to claim 1, wherein the powered fan is an electric ducted fan.

5. The device according to claim 1, wherein the powered fan is operated to provide a negative airflow to create a vacuum effect.

6. The device according to claim 1, wherein the elongate ducting arrangement is comprised of one or more modules.

7. The device according to claim 6, wherein the elongate ducting arrangement comprises at least two telescopic modules.

8. The device according to claim 1, wherein an end of the elongate ducting arrangement distal to the powered fan has a nozzle.

9. The device according to claim 8, wherein the nozzle is formed as a hollow sharpened end.

10. The device according to claim 8, wherein the nozzle is formed in a hollow spike.

11. The device according to claim 1, wherein the elongate ducting further includes an air bleed arrangement that is configured to provide an air flow across a lens of the camera.

12. The device according to claim 1, further comprising a disc cutting tool.

13. The device according to claim 12, further comprising an impeller that is powered by the air flow or the gas flow from the air or gas flow generation device, the disc cutting tool being operably linked to the impeller.

14. The device according to claim 12, wherein the disc cutting tool further comprises a bird's mouth element.

15. The device according to claim 1, wherein:

an end of the elongate ducting arrangement distal to the powered fan has a nozzle; and at least one of the powered fan, the elongate ducting arrangement, and the nozzle is manufactured from a lightweight composite material.

16. The device according to claim 15, wherein the lightweight composite material comprises at least one material selected from the group consisting of: aluminium; carbon fiber reinforced resin; and glass fiber reinforced resin.

17. A method of uncovering unexploded ordnance, the method comprising:

deploying a remote operated vehicle (ROV) fitted with a terrain disruption device in the vicinity of the ordnance, the ROV having a camera and an extendable arm, and the terrain disruption device comprising:

an air or gas flow generation device configured to generate air or gas flow and mounted on the ROV, and a component or tool powered by the air or gas flow generated by the air or gas flow generation device, and operating the air or gas flow generation device to remove loose terrain from around the ordnance, wherein:

the air or gas flow generation device comprises a powered fan and an elongate ducting arrangement to direct air flow or gas flow, and the air or gas flow generation device is configured to generate the air flow or the gas flow that disrupts the terrain in the vicinity of unexploded ordnance, so as to uncover the ordnance without causing activation of the ordnance.

18. A kit of parts comprising:

a remote operated vehicle (ROV), the ROV including a camera;

an air or gas flow generation device configured to generate air or gas flow;

an elongate ducting arrangement;

a nozzle; and a component or tool powered by the air or gas flow generated by the air or gas flow generation device, wherein:

the air or gas flow generation device is a powered fan; and the air or gas flow generation device is configured to generate the air flow or the gas flow that disrupts terrain in the vicinity of unexploded ordnance, so as to uncover the ordnance without causing activation of the ordnance.

19. The method according to claim 17, wherein the camera is mounted on the extendable arm.

20. The kit according to claim 18, wherein the camera is mounted on the ROV.

21. The device according to claim 10, wherein the hollow spike has a trapezoidal shape such that a rearward surface of the hollow spike acts as a barb, flange or lip.

* * * * *